US009175836B2

(12) United States Patent
Schatz

(10) Patent No.: US 9,175,836 B2
(45) Date of Patent: Nov. 3, 2015

(54) OBJECT RETENTION SYSTEM

(71) Applicant: Warren M. Schatz, West Fargo, ND (US)

(72) Inventor: Warren M. Schatz, West Fargo, ND (US)

( * ) Notice: Subject to any disclaimer, the term of this patent is extended or adjusted under 35 U.S.C. 154(b) by 0 days.

(21) Appl. No.: 14/520,890

(22) Filed: Oct. 22, 2014

(65) Prior Publication Data

US 2015/0153030 A1 Jun. 4, 2015

Related U.S. Application Data

(60) Provisional application No. 61/911,057, filed on Dec. 3, 2013.

(51) Int. Cl.

| | |
|---|---|
| ***A47H 13/00*** | (2006.01) |
| ***F21V 21/08*** | (2006.01) |
| ***F21V 21/34*** | (2006.01) |

(52) U.S. Cl.

CPC ..... *F21V 21/0816* (2013.01); *F21V 21/34* (2013.01)

(58) Field of Classification Search

CPC ..... F21S 4/003; F21V 21/14; F21V 21/145; F21V 21/088; F21V 21/0816; F21V 21/34; F21W 2121/04

USPC ..... 211/124; 248/48.2, 216.1, 217.3, 231.9; 403/381

See application file for complete search history.

(56) References Cited

U.S. PATENT DOCUMENTS

| | | | | | |
|---|---|---|---|---|---|
| 3,204,090 | A | * | 8/1965 | Kvarda, Jr. | 362/249.01 |
| 3,476,343 | A | * | 11/1969 | Burrell | 248/216.4 |
| 4,795,121 | A | | 1/1989 | Comito | |
| 4,957,251 | A | * | 9/1990 | Hubbard | 248/68.1 |
| 5,149,026 | A | * | 9/1992 | Allen | 248/68.1 |
| 5,277,512 | A | * | 1/1994 | Dwillies | 403/348 |
| 5,593,115 | A | * | 1/1997 | Lewis | 248/68.1 |
| 5,664,877 | A | | 9/1997 | Wu | |
| 5,707,136 | A | * | 1/1998 | Byers | 362/145 |
| 5,746,325 | A | * | 5/1998 | Lee | 211/40 |
| 6,033,088 | A | | 3/2000 | Contigiani | |
| 6,050,709 | A | * | 4/2000 | Hastings | 362/375 |
| 6,109,765 | A | | 8/2000 | Blanton | |
| 6,216,320 | B1 | * | 4/2001 | Schauermann | 24/458 |
| 6,217,192 | B1 | | 4/2001 | Stratton | |
| 6,296,211 | B1 | * | 10/2001 | Snyder | 248/71 |
| 6,305,822 | B1 | * | 10/2001 | Lin | 362/249.14 |
| 6,843,583 | B2 | | 1/2005 | Winter | |
| 6,981,781 | B2 | | 1/2006 | Tseng | |
| 7,066,618 | B1 | * | 6/2006 | Little | 362/147 |
| 8,152,112 | B2 | | 4/2012 | Miller | |
| 8,251,543 | B2 | | 8/2012 | Bauer | |
| 8,262,250 | B2 | | 9/2012 | Li | |
| 2014/0112001 | A1 | | 4/2014 | Noh | |

* cited by examiner

*Primary Examiner* — Korie H Chan
(74) *Attorney, Agent, or Firm* — Neustel Law Offices

(57) ABSTRACT

An object retention system which aids in safely and efficiently securing ornamental objects such as lights across a structure such as a roof. The object retention system generally includes a retainer rail adapted to be secured to a structure such as a gutter or roof gable. The retainer rail includes a receiver rail having a plurality of receivers adapted to removably retain one or more retainers therein. Each of the retainers is adapted to secure an object such as a decorative light against the retainer rail. The retainer rail includes a channel for aiding in securing to a gutter and a barbed portion for aiding in securing to other structures, such as between roof shingles and flashing. A connector is provided for seamlessly interconnecting multiple retainer rails to each other across a structure.

7 Claims, 12 Drawing Sheets

OBJECT RETENTION SYSTEM

CROSS REFERENCE TO RELATED APPLICATIONS

I hereby claim benefit under Title 35, United States Code, Section 119(e) of United States provisional patent application Ser. No. 61/911,057 filed Dec. 3, 2013. The Ser. No. 61/911,057 application is currently pending. The Ser. No. 61/911,057 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an object retainer and more specifically it relates to an object retention system which aids in safely and efficiently securing ornamental objects such as lights across a structure such as a roof.

2. Description of the Related Art

Any discussion of the related art throughout the specification should in no way be considered as an admission that such related art is widely known or forms part of common general knowledge in the field.

It is increasingly common for homes or other structures to be decorated with various ornamental objects, such as ornamental lights. For example, during the holiday season throughout the world, houses are often decorated with ornamental lights or other objects which extend across the roof of the houses.

It can be exceedingly difficult to secure such ornamental objects to a structure. Often, staples or nails are utilized to temporarily or permanently mount the decorative objects to the structure. This can create significant risks for the person installing the objects. The swinging of a hammer can lead to imbalance and thus result in a fall from a height. Additionally, there is always the risk that a nail or staple will injure the installer of the objects.

Because of the inherent problems with the related art, there is a need for a new and improved object retention system which aids in safely and efficiently securing ornamental objects such as lights across a structure such as a roof.

BRIEF SUMMARY OF THE INVENTION

The invention generally relates to an object retainer which includes a retainer rail adapted to be secured to a structure such as a gutter or roof gable. The retainer rail includes a receiver rail having a plurality of receivers adapted to removably retain one or more retainers therein. Each of the retainers is adapted to secure an object such as a decorative light against the retainer rail. The retainer rail includes a channel for aiding in securing to a gutter and a barbed portion for aiding in securing to other structures, such as between roof shingles and flashing. A connector is provided for seamlessly interconnecting multiple retainer rails to each other across a structure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter o f the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
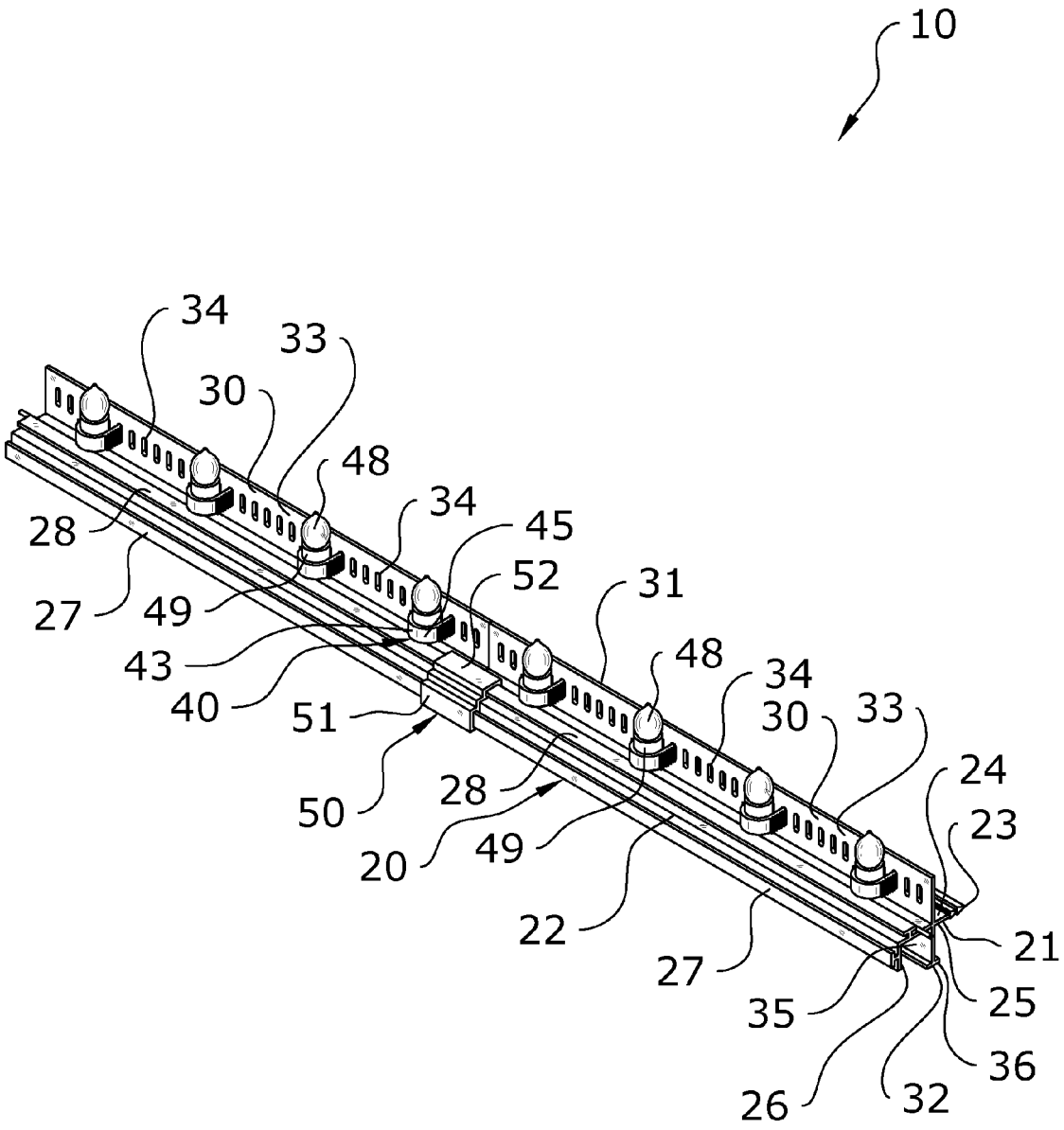
FIG. 1 is an upper perspective view of the present invention with two interconnected retainer rails.

A. Overview.

Turning now descriptively to the drawings, in which similar reference characters denote similar elements throughout the several views, FIGS. 1 through 15 illustrate an object retention system 10, which comprises a retainer rail 20 adapted to be secured to a structure such as a gutter 12 or roof gable. The retainer rail 20 includes a receiver rail 33 having a plurality of receivers 34 adapted to removably retain one or more retainers 40 therein. Each of the retainers 40 is adapted to secure an object 48 such as a decorative light against the retainer rail 20. The retainer rail 20 includes a channel 37 for aiding in securing to a gutter 12 and a barbed portion 29 for aiding in securing to other structures, such as between roof shingles 14 and flashing 15. A connector 50 is provided for seamlessly interconnecting multiple retainer rails 20 to each other across a structure.

B. Retainer Rail.

As shown throughout the figures, the present invention includes a retainer rail 20 which is adapted to be secured to a structure for mounting a plurality of objects 48 such as decorative lights. The shape, size, and configuration of the retainer rail 20 may vary and thus should not be construed as limited by the exemplary figures. The overall design of the retainer rail 20 will necessarily be adjusted for different types of structures, different types of objects 48, and different applications of the present invention.

In the exemplary embodiment shown throughout the figures, the retainer rail 20 comprises a horizontal portion 21 and a vertical portion 30. In the embodiment shown in the figures, the horizontal portion 21 bisects the vertical portion 30 and the vertical portion 30 bisects the horizontal portion 21 to create a cross-shaped cross-section. The horizontal and vertical portions 21, 30 could be comprised of separate structures interconnected with each other, or could be comprised of a unitary, integral structure.

The horizontal and vertical portions 21, 30 of the retainer rail 20 both aid in securing the retainer rail 20 to a structure (such as a roof gable). The horizontal portion 21 is also utilized to connect multiple retainer rails 20 together as shown in FIG. 1. The vertical portion 30 additionally provides stiffening and includes the receiver rail 33 which contains the receivers 34 of the present invention.

Figure 2:
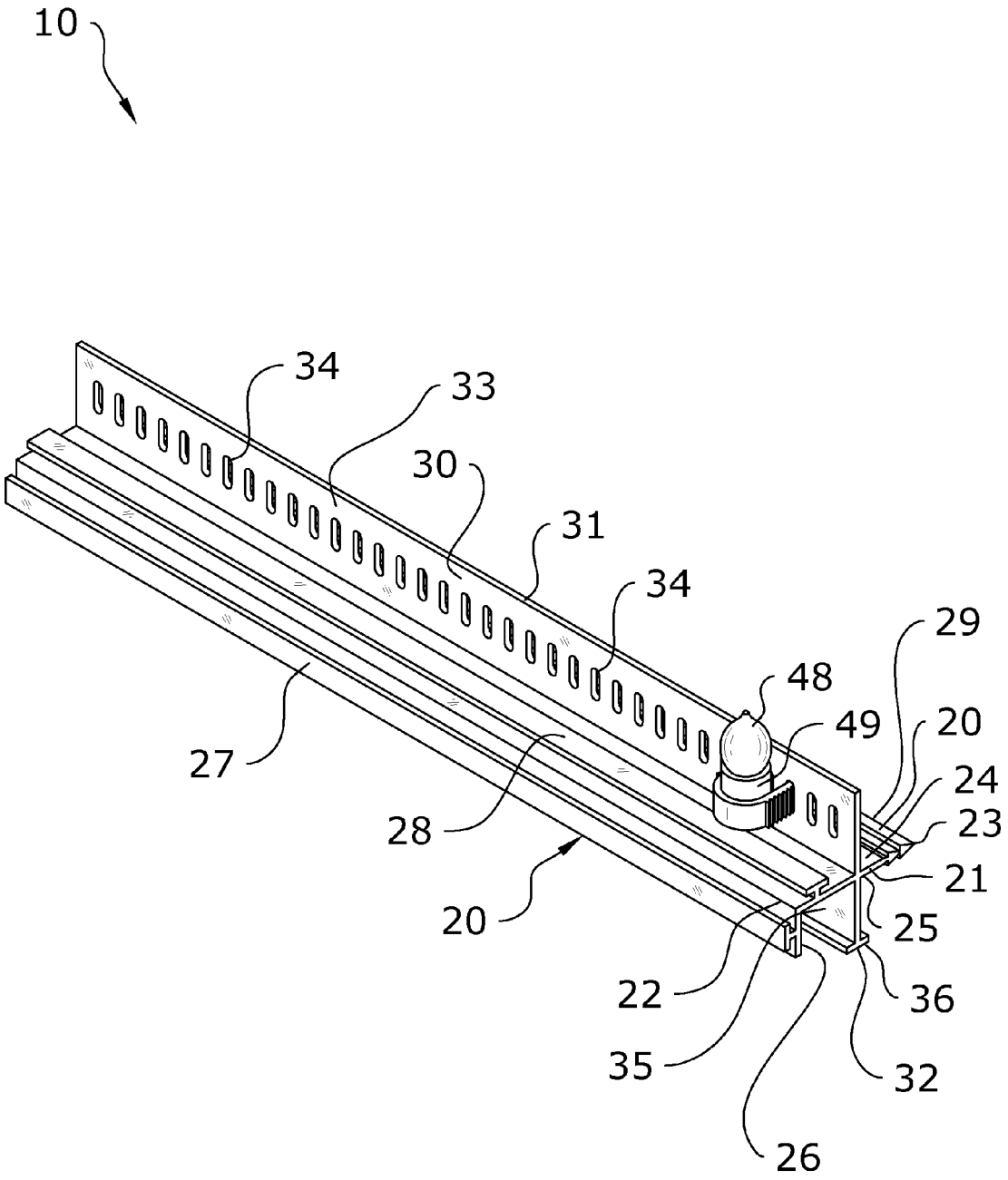
FIG. 2 is an upper perspective view of a retainer rail of the present invention.
Figure 3:
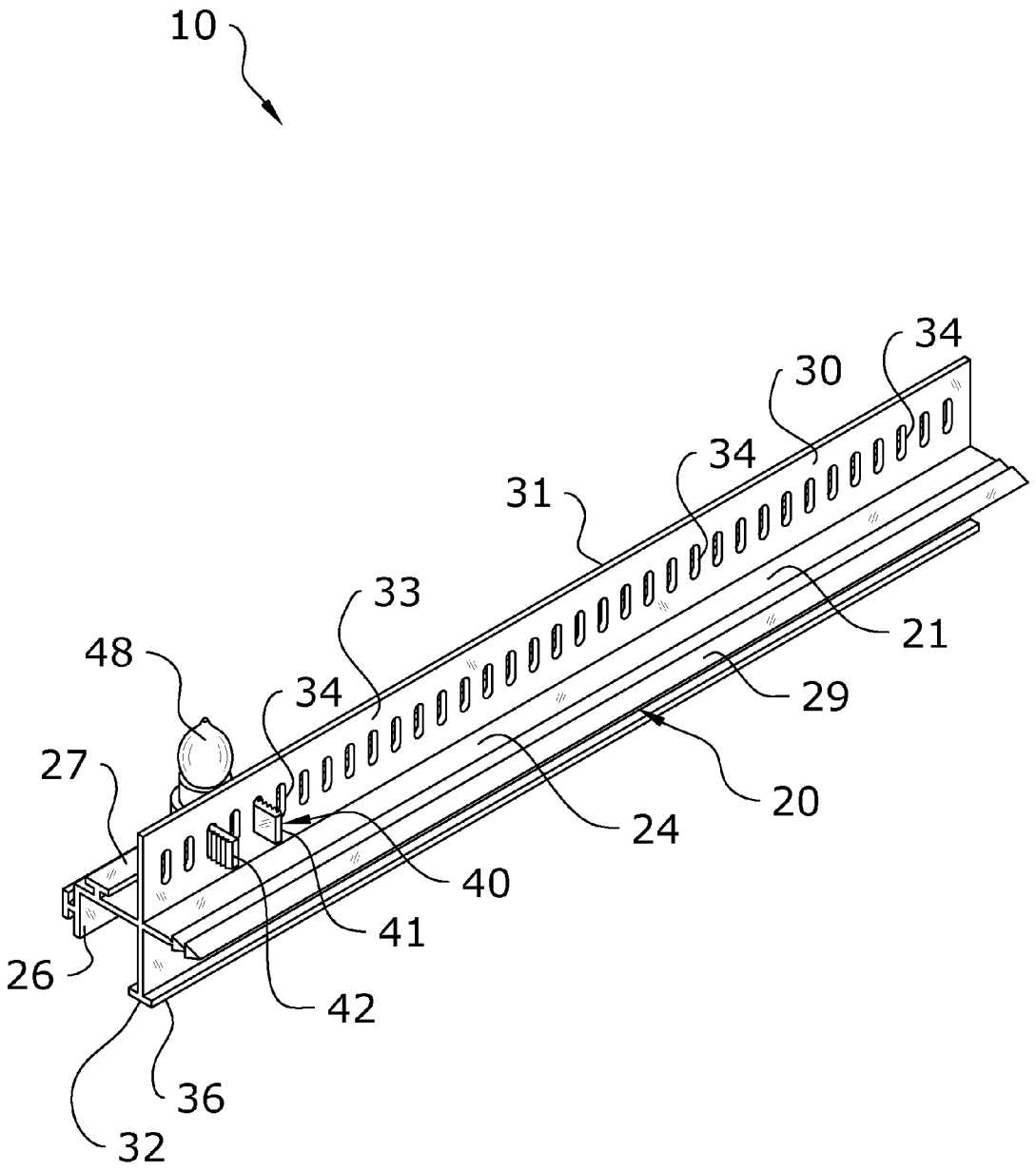
FIG. 3 is a rear perspective view of a retainer rail of the present invention.

As best shown in FIG. 2, the horizontal portion 21 of the retainer rail 20 includes a first end 22, a second end 33, an upper surface 24, and a lower surface 25. The first end 22 of the horizontal portion 21 of the retainer rail 20 is generally adapted to point away from the structure to which the retainer rail 20 is mounted. The second end 23 of the horizontal portion 21 is generally adapted to point toward the structure to which the retainer rail 20 is mounted.

The first end 22 of the horizontal portion 21 of the retainer rail 20 will generally include a downward projection 26. The downward projection 26 extends for the length of the retainer rail 20 and is oriented at a right angle with respect to the first end 22 of the horizontal portion 21.

The first end 22 of the horizontal portion 21 and the downward projection 26 are utilized with the connector 50 of the present invention to link multiple retainer rails 20 together as shown in FIG. 1. Thus, the upper surface 24 of the horizontal portion 21 of the retainer rail 20 includes a first connector rib 27 and the downward projection 26 includes a second connector rib 28. Preferably, the connector ribs 27, 28 are oriented at a right angle with respect to each other as shown in the figures.

Each of the connector ribs 27, 28 extends for the length of the retainer rail 20 and comprise tabs, linkages, or other structures adapted to removably retain the connector 50 when mounted thereto as discussed herein. It should be appreciated that the structure of the connector ribs 27, 28 may vary in different embodiments, and thus the connector ribs 27, 28 should not be construed as limited in scope by the exemplary figures.

Figure 10:
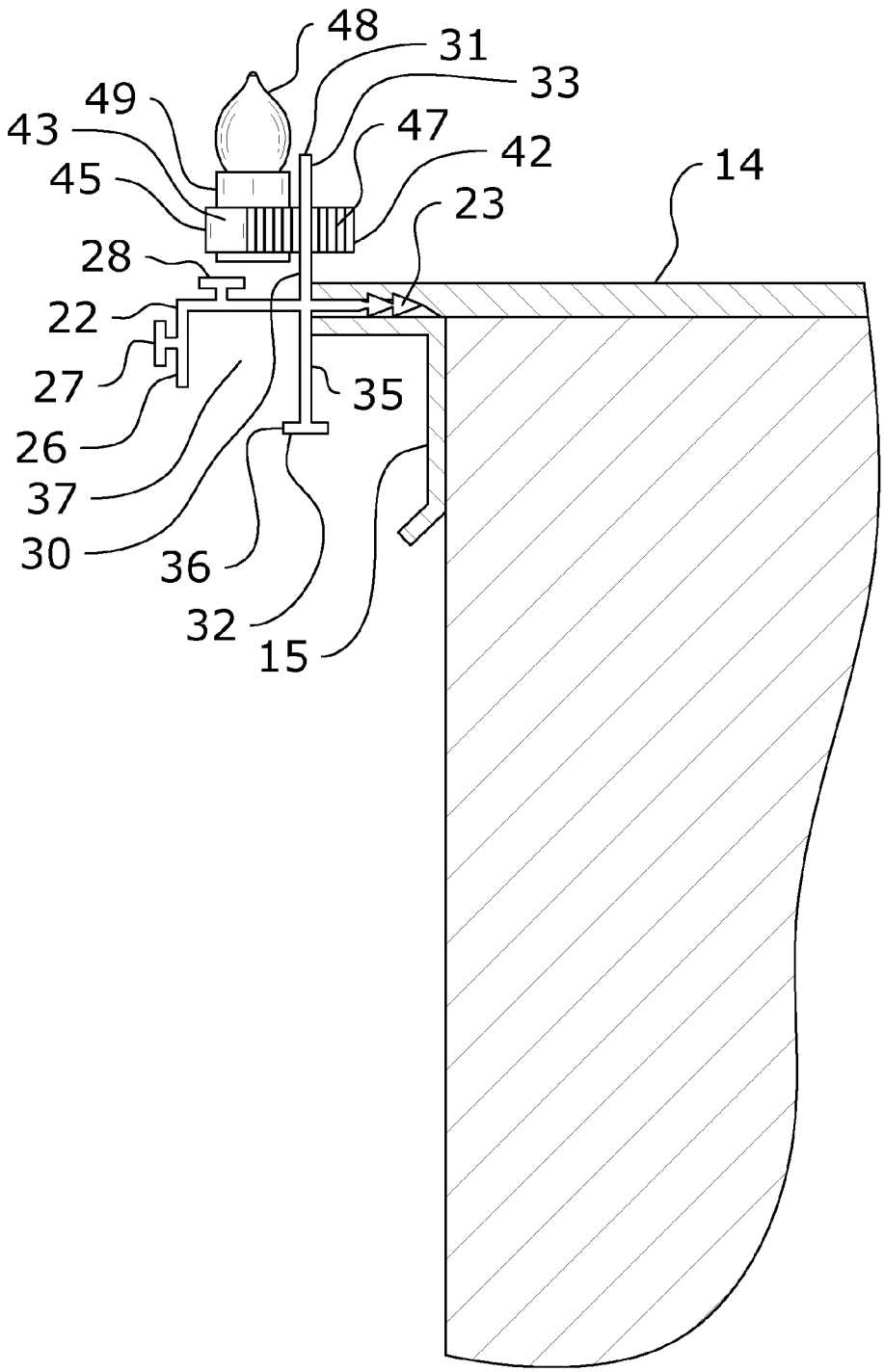
FIG. 10 is a side sectional view of the present invention installed between flashing and shingles.

The second end 23 of the horizontal portion 21 of the retainer rail 20 may be utilized to aid in mounting the retainer rail 20 to a structure, such as shown in FIG. 10. In such embodiments, the second end 23 of the horizontal portion 21 of the retainer rail 20 may include a barbed portion 29. This barbed portion 29 is adapted to catch between roof shingles 14 and flashing 15 as shown in FIG. 10 to secure the retainer rail 20 to a structure. The number, structure, and orientation of the barbs of the barbed portion 29 may vary for different embodiments of the present invention.

The vertical portion 30 of the retainer rail 20 includes an upper end 31 and a lower end 32. The vertical portion 30 of the retainer rail 20 is generally bisected by the horizontal portion 21 into an upper half and a lower half. The upper half of the vertical portion 30 will generally comprise a receiver rail 33 for receiving and removably retaining one or more objects 48 with the retainer 40 of the present invention.

Figure 4:
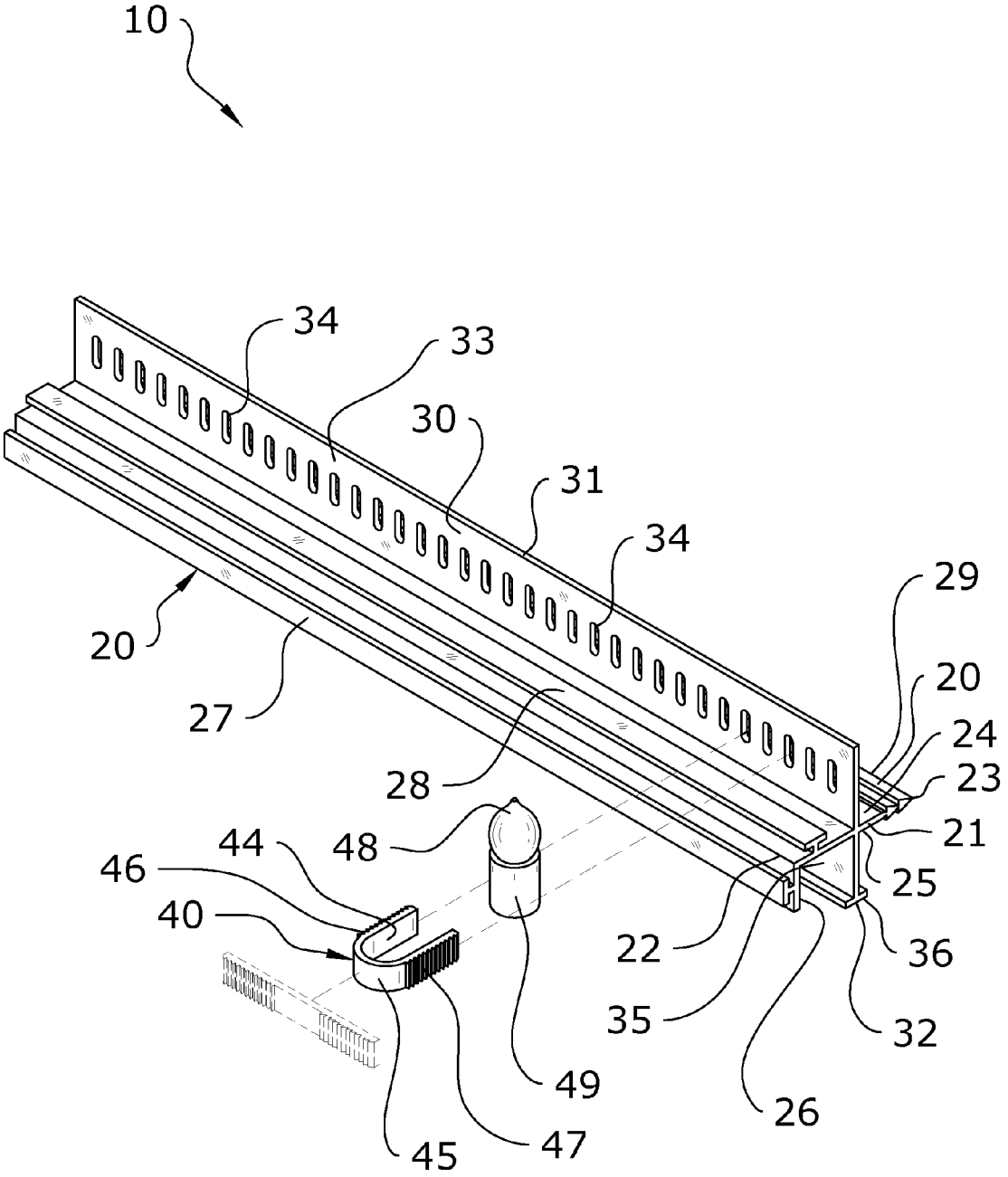
FIG. 4 is an upper perspective view illustrating alignment of an object for retention against the retainer rail.

The receiver rail 33 of the present invention is best shown in FIG. 4. As shown therein, the receiver rail 33 generally comprises the upper half of the vertical portion 30 of the retainer rail 20. The receiver rail 33 generally extends for the entire length of the retainer rail 20. The shape, size, structure, and configuration of the receiver rail 33 may vary in different embodiments. The receiver rail 33 may be integrally formed with the retainer rail 20 as shown in the figures or, in alternate embodiments, may comprise one or more separate structures which are secured to the retainer rail 20.

Figure 5:
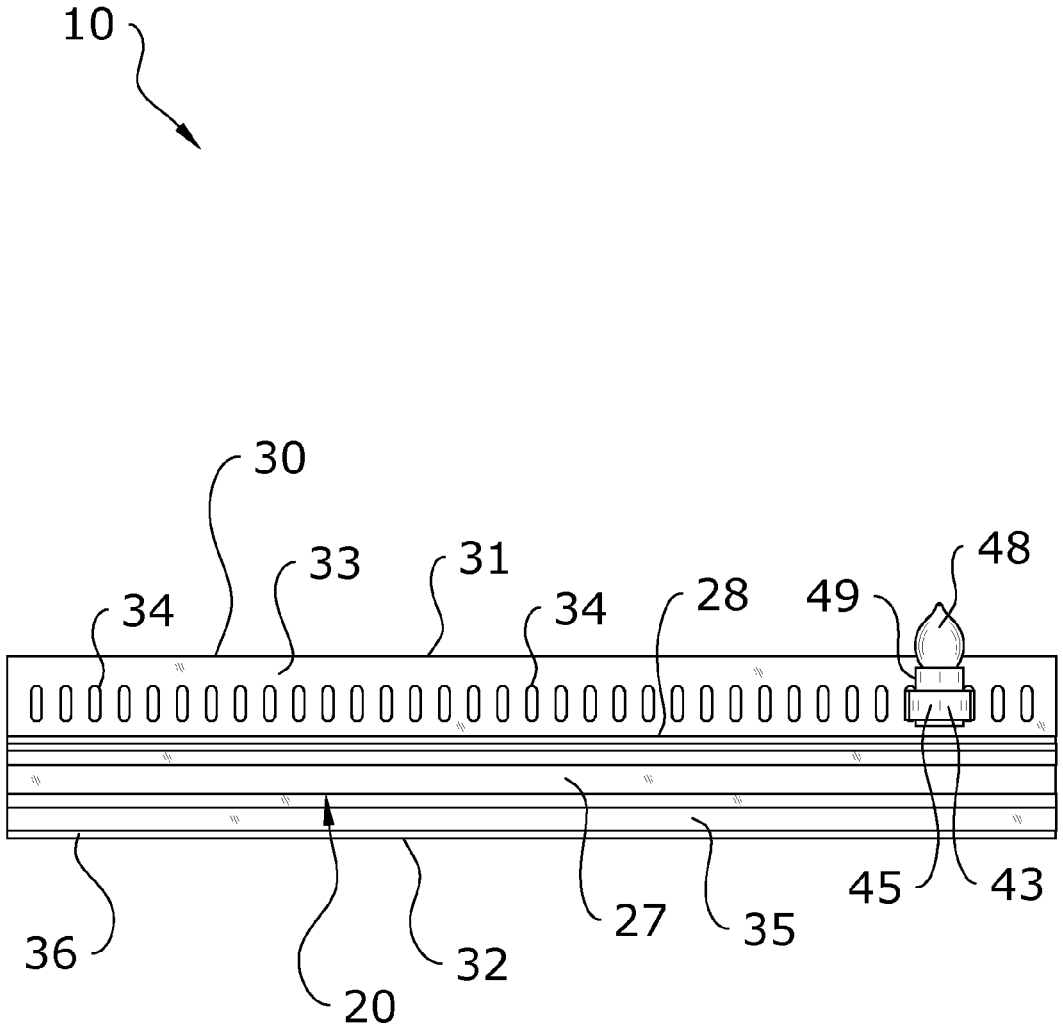
FIG. 5 is a frontal view of the present invention.
Figure 6:
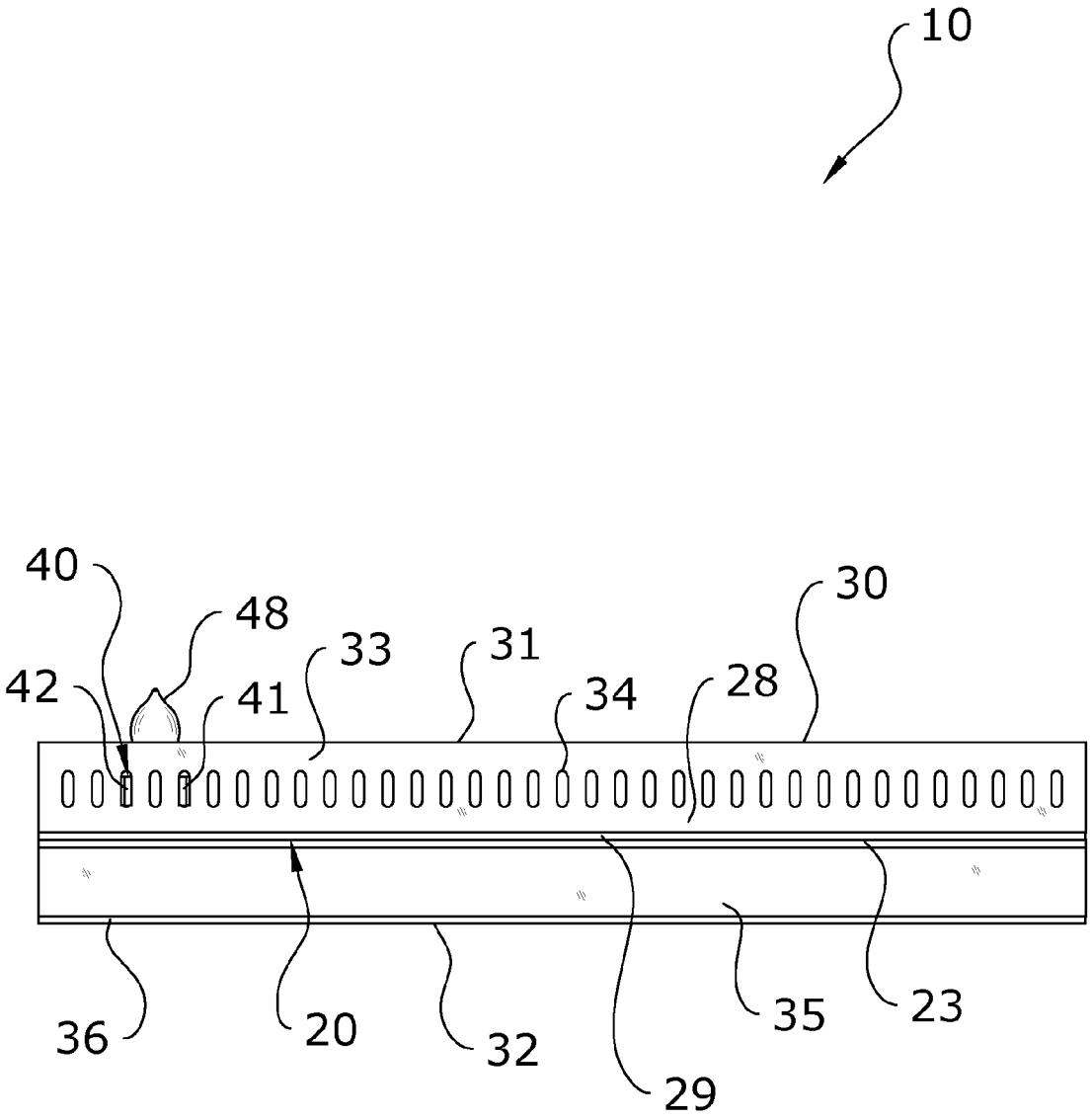
FIG. 6 is a rear view of the present invention.
Figure 7:
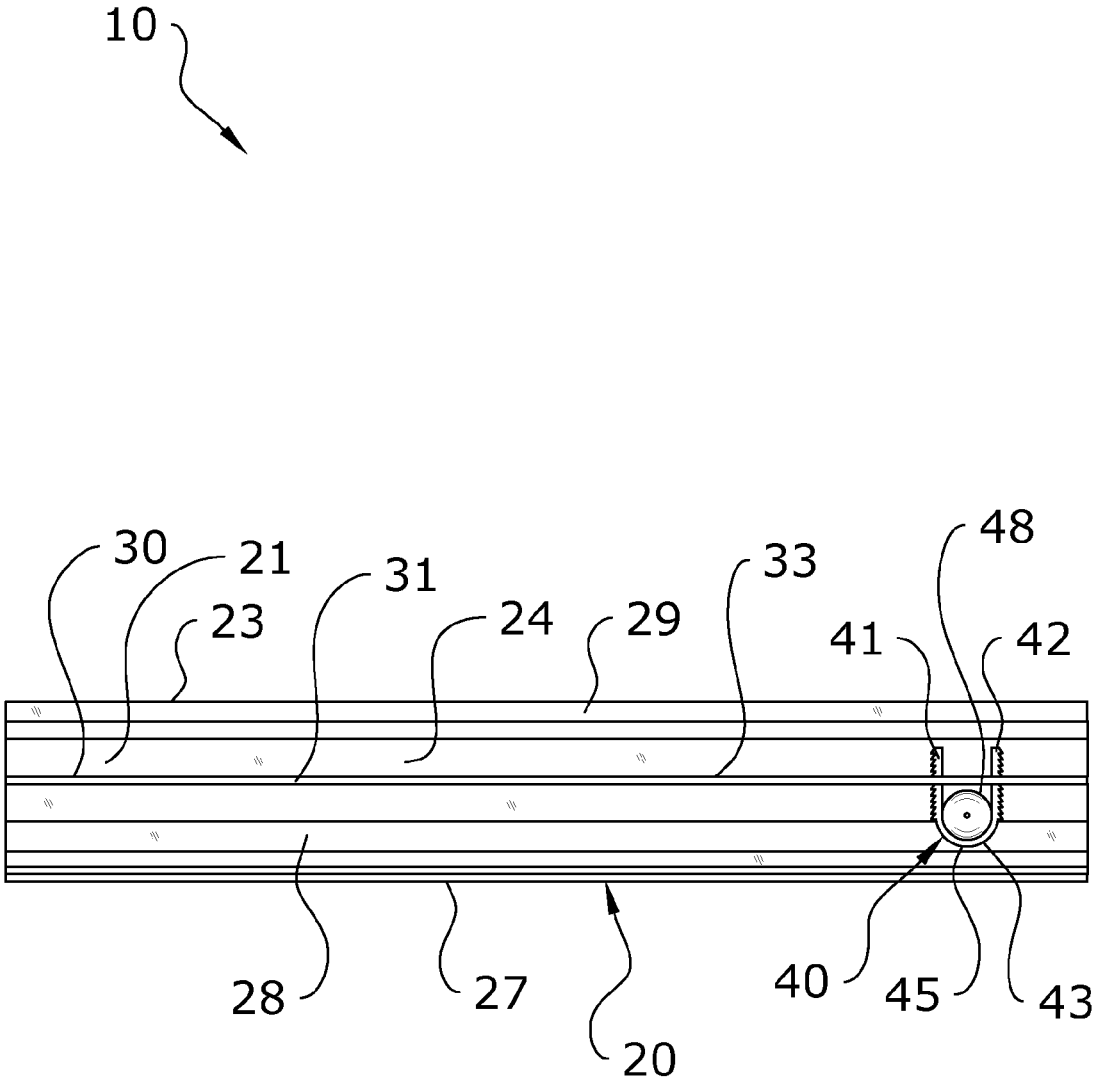
FIG. 7 is a top view of the present invention.
Figure 8:
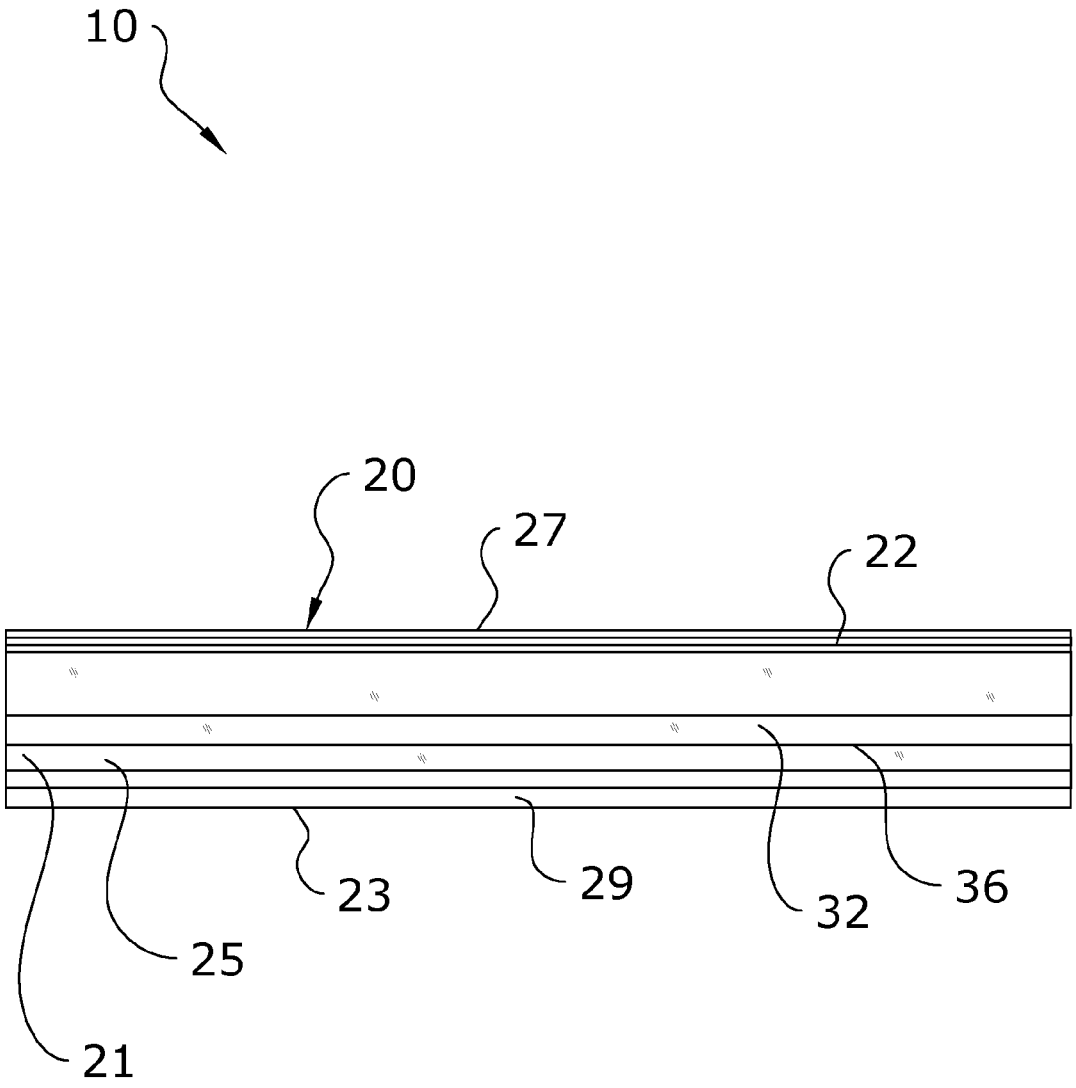
FIG. 8 is a bottom view of the present invention.

As best shown in FIG. 5, the receiver rail 33 includes one or more receivers 34 extending across its length. Each of the receivers 34 is adapted to act as a retention point for the retainers 40 of the present invention. The receivers 34 will generally comprise notches, depressions, or openings which extend either partially or fully through the receiver rail 33.

The shape, size, configuration, orientation, and number of receivers 34 on the receiver rail 33 may vary widely in different embodiments of the present invention. The figures illustrate the receivers 34 as comprising a plurality of equally-spaced openings extending across the length of the retainer rail 20. In some embodiments, the receivers 34 may only extend across a portion of the length of the retainer rail 20. Each of the retainers 40 used with the present invention will generally utilize a pair of receivers 34 as shown in the figures, though other configurations may be utilized in different embodiments.

The lower half of the vertical portion 30 extends downwardly from the horizontal portion 21 of the retainer rail 20 as shown in FIG. 1. The lower half of the vertical portion 30 is utilized both in securing the retainer rail 20 to a structure but also as a stiffening structure for the retainer rail 20 overall. Thus, the lower end 32 of the vertical portion 30 in preferred embodiments may include a stiffener rib 36 as shown throughout the figures. The stiffener rib 36 comprises a rib extending for the length of the lower end 32 of the vertical portion 30 to increase the strength of the present invention overall.

Figure 9:
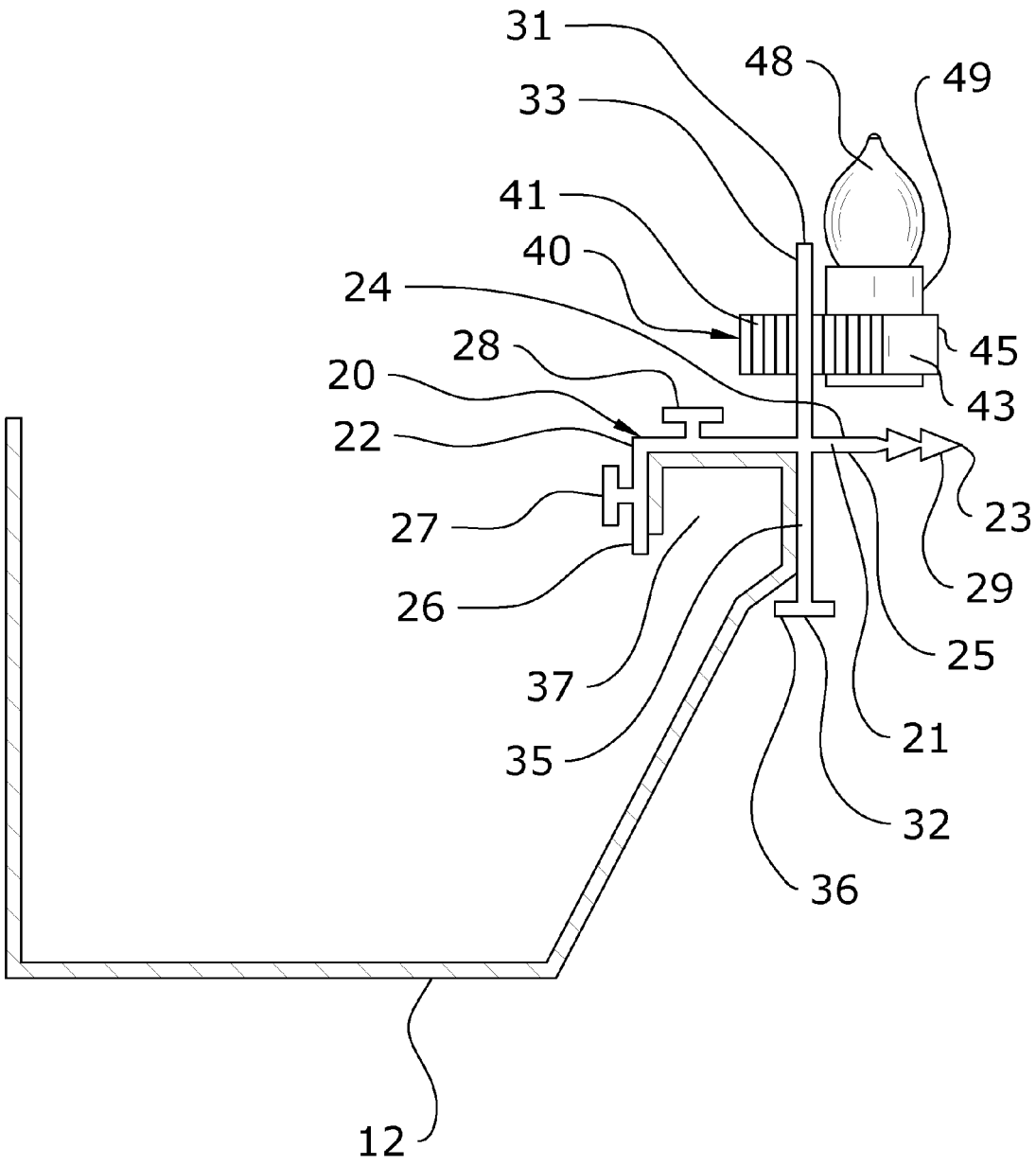
FIG. 9 is a side sectional view of the present invention installed on a gutter.

As best shown in FIG. 9, a channel 37 is defined between the vertical portion 30 of the retainer rail 20, the horizontal portion 21 of the retainer rail 20, and the downward projection 26 of the horizontal portion 21 of the retainer rail 20. This channel 37 extends for the length of the retainer rail 20 and is adapted to receive a portion of a structure to which the present invention is being mounted. As shown in FIG. 9 and discussed herein, the channel 37 may be utilized to secure the retainer rail 20 to a gutter 12 by positioning the upper lip 13 of the gutter 12 within the channel 37.

C. Retainer.

Figure 11:
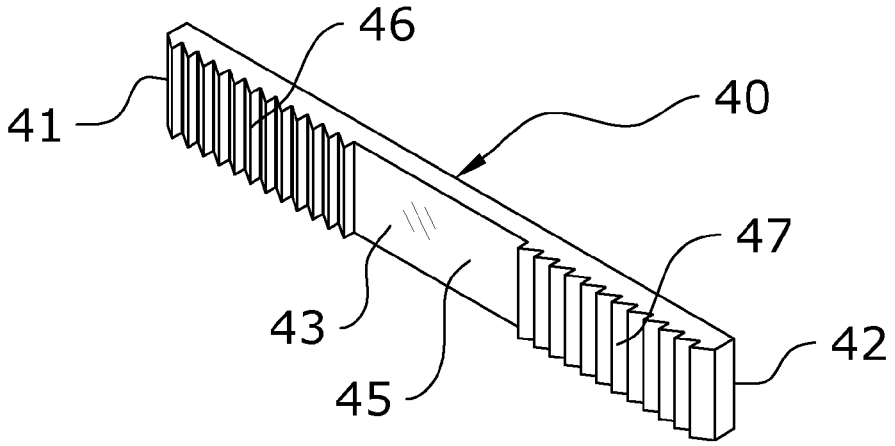
FIG. 11 is a frontal perspective view of a retainer for use with the present invention.
Figure 12:
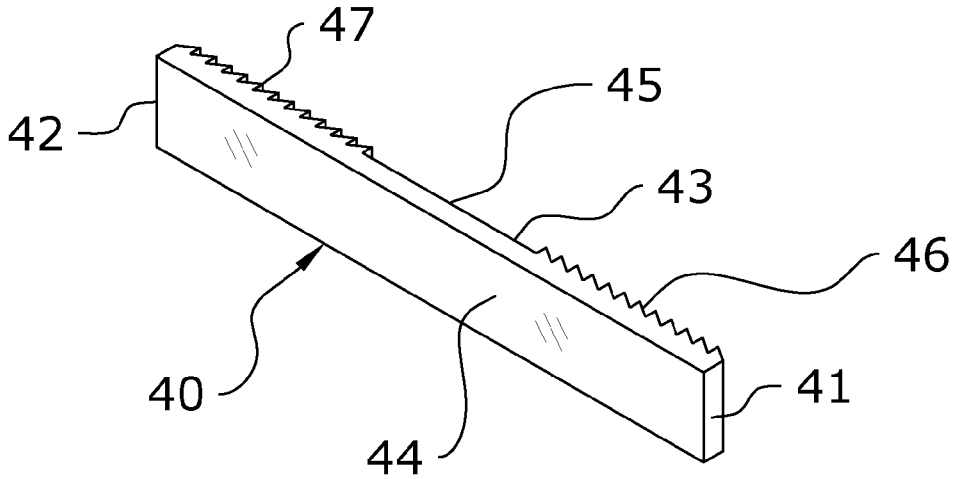
FIG. 12 is a rear perspective view of a retainer for use with the present invention.
Figure 13:
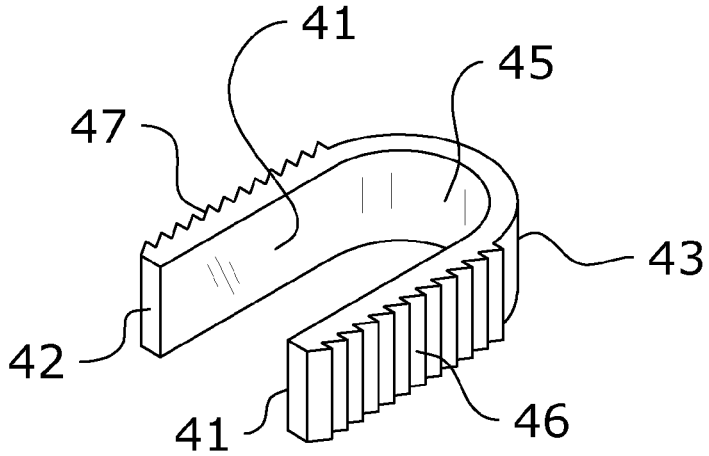
FIG. 13 is a rear perspective view of a retainer in a folded state.

The present invention utilizes retainers 40 for retaining the objects 48 of the present invention against the receiver rail 33. The structure of an exemplary retainer 40 for use with the present invention is shown in FIGS. 11-13. The retainer 40 utilized may vary widely in different embodiments as to its shape, structure, configuration, and size. Thus, the shape, structure, configuration, and size of the retainers 40 should not be construed as limited in scope by the exemplary figures. It should also be appreciated that any number of retainers 40 may be utilized with the present invention, depending on the number of objects 48 desired to be secured thereto.

In a preferred embodiment as best shown in FIGS. 11-13, each retainer 40 comprises an elongated, rectangular configuration with a first end 41, a second end 42, an outer surface 43, and an inner surface 44. As shown in FIG. 11, the outer surface 43 of each retainer 40 will generally include first ribs 46 near the first end 41 of the retainer 40 and second ribs 47 near the second end 42 of the retainer 40.

A central portion 45 of the retainer 40 may separate the first and second ribs 46, 47 from each other as shown in FIG. 11. At least the central portion 45 will preferably be flexible so as to allow the retainer 40 to be bent as shown in FIG. 13. In some embodiments, the entirety of the retainer 40 may be flexible. The size of the central portion 45 with respect to the size of the ribs 46, 47 may vary in different embodiments, and should not be limited by the exemplary figures.

The ribs 46, 47 are utilized to secure the retainer 40 to the retainer rail 20. Generally, the first ribs 46 will retain the retainer 40 within a first receiver 34 of the receiver rail 33 while the second ribs 47 will retain the retainer 40 within a second receiver 34 of the receiver rail 33, such as shown in FIG. 4. The shape, size, orientation, and number of ribs 46, 47 may vary in different embodiments and should not be construed as limited by the exemplary embodiment shown in the figures.

D. Connector.

Figure 14:
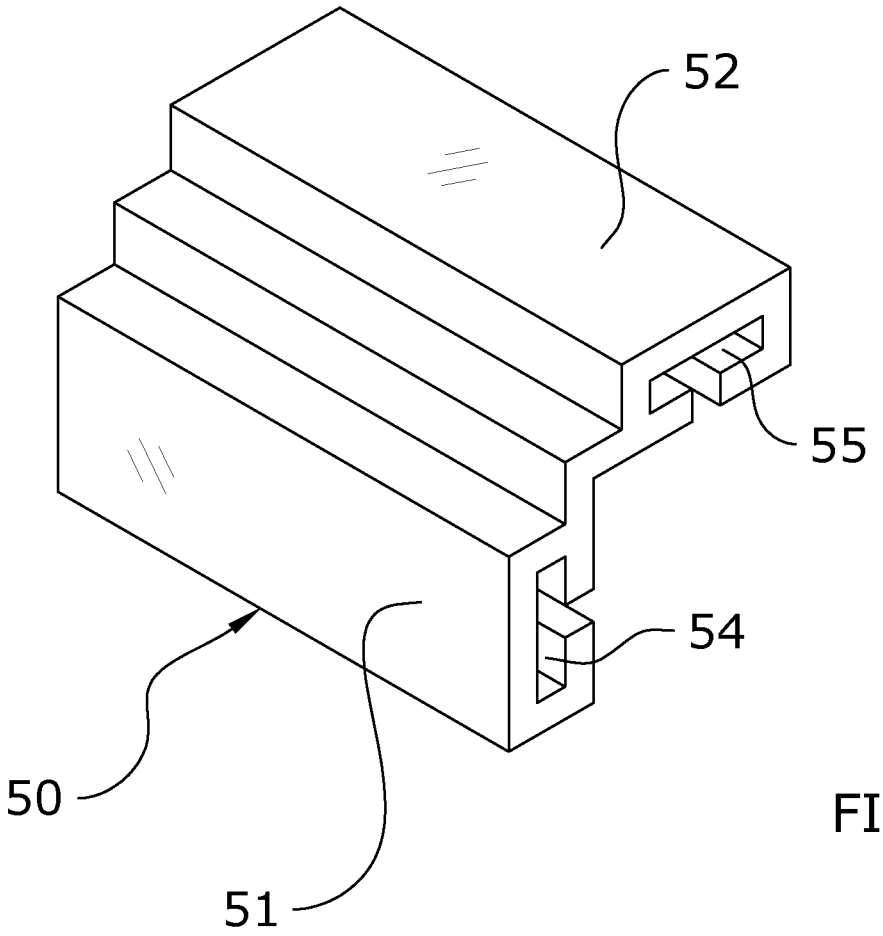
FIG. 14 is an upper perspective view of a connector of the present invention.
Figure 15:
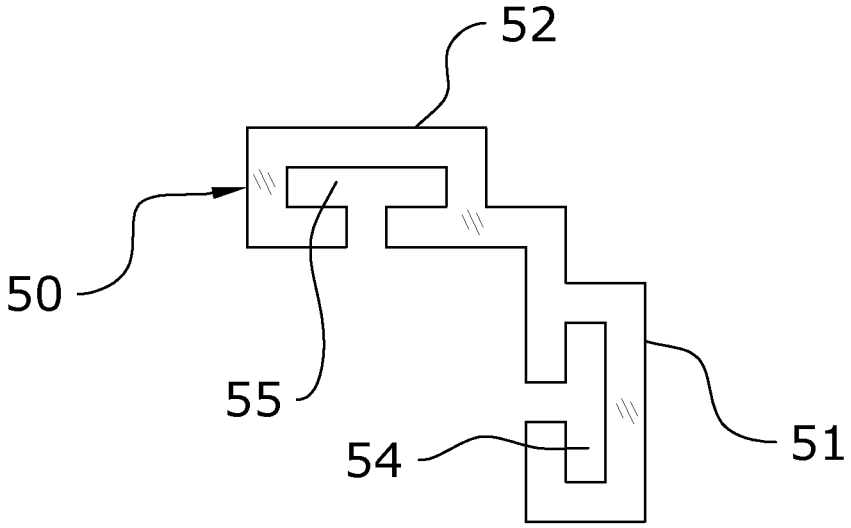
FIG. 15 is a side view of a connector of the present invention.

As best shown in FIGS. 14 - 15, a connector 50 is utilized to connect multiple retainer rails 20 to each other. This allows for the present invention to be installed along a surface which is significantly longer than the length of the retainer rails 20 themselves. By securing multiple retainer rails 20 together, more flexibility may be attained as to the applicability of the present invention to various structures. It also aids in transport of the retainer rails 20, since they can be significantly smaller in length if adapted to be interconnected together.

Any structure capable of interconnecting a pair of retainer rails 20 may be utilized for the connector 50. In a preferred embodiment, the connector 50 will comprise a first portion 51 and a second portion 52 as shown in FIG. 14. The first portion 51 will generally extend horizontally while the second portion 52 will generally extend vertically.

The first portion 51 of the connector 50 includes a first connector cavity 54 which extends horizontally through the first portion 51 of the connector 50. When interconnecting a pair of retainer rails 20 together, the first portion 51 will fit over the horizontal portions 21 of the interconnected rails 20, with the first connector ribs 27 of each of the rails 20 being positioned and secured within the first connector cavity 54.

The second portion 52 of the connector 50 includes a second connector cavity 55 which extends horizontally through the second portion 52 of the connector 50. The second connector cavity 55 is generally oriented at a right angle with respect to the first connector cavity 54. When interconnecting a pair of retainer rails 20 together, the second portion 52 will fit over the downward projections 26 of the interconnected rails 20, with the second connector ribs 28 of each of the rails 20 being positioned and secured within the second connector cavity 55.

E. Operation of Preferred Embodiment.

In use, the retainer rail 20 will generally first be secured to a structure such as a roof gable or gutter 12. FIG. 9 shows the retainer rail 20 being secured to a gutter 12. As shown therein, the upper lip 13 of the gutter 12 is inserted within the channel 37 defined between the vertical portion 30 of the retainer rail 20, the horizontal portion 21 of the retainer rail 20, and the downward projection 26 of the horizontal portion 21. The upper lip 13 of the gutter 12 will thus be sandwiched within the channel 37 to be retained against the gutter 12. This step can be performed multiple times to secure multiple retainer rails 20 to the gutter 12.

FIG. 10 shows the retainer rail 20 being secured to a roof gable. As shown there, the barbed portion 29 of the horizontal portion 21 of the retainer rail 20 is inserted between the roof shingles 14 and the flashing 15. The barbed portion 29 will act to retain the horizontal portion 21 in a sandwiched position between the shingles 14 and the flashing 15, thus retaining the retainer rail 20 to the structure. This step may be performed multiple times to secure multiple retainer rails 20 to the roof gable.

In cases where multiple retainer rails 20 are to be interconnected, they will be secured to the structure side-by-side as shown in FIG. 1. To ensure that they do not slip apart or become dislodged, the retainer rails 20 may be interconnected through usage of connectors 50. As shown in FIG. 1, a connector 50 may be utilized to connect two retainer rails 20 together. The first connector ribs 27 of each of the neighboring retainer rails 20 will be positioned and secured within the first connector cavity 54 of the connector 50. Similarly, the second connector ribs 27 of each of the neighboring retainer rails 20 will be positioned and secured within the second connector cavity 55 of the connector 50. Thus, multiple retainer rails 20 may be interconnected for the entire length of a structure such as a gutter 12.

With the retainer rails 20 properly secured to the structure, the objects 48 may be secured to the retainer rail 20. It should be appreciated that a wide range of decorative objects 48 may be secured to the present invention, including holiday ornaments, trinkets, lights, and the like. The figures illustrate lights 48 being secured to the retainer rail 20, such as for holiday lighting.

To secure the objects 48 to the retainer rail 20, a retainer 40 will be utilized for each of the objects 48. Each object 48 will be positioned between a pair of receivers 34 on the receiver rail 33. The first end 41 of the retainer 40 will be positioned within a first receiver 34 as the central portion 45 of the retainer 40 is bent or formed around the object 48 (or the base 49 of the object 48 if present).

Once bent around the object 48, the second end 42 of the retainer 40 will be positioned within a second receiver 34. The ribs 46, 47 of the retainer 40 will thus be positioned within the receivers 34 to be retained therein, with the first ribs 46 securing the first end 41 of the retainer 40 within the first receiver 34 and the second ribs 47 securing the second end 42 of the retainer 40 within the second receiver 34 as shown in FIG. 1.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An object retention system, comprising:

a retainer rail including a horizontal portion and a vertical portion, wherein said retainer rail includes a plurality of receivers, wherein a first end of said horizontal portion includes a downward projection, wherein said horizontal portion includes a first connector rib and wherein said downward projection includes a second connector rib;

a retainer including a first end and a second end, wherein said retainer includes first ribs near said first end and second ribs near said second end;

an object, wherein said object is adapted to be removably secured to said retainer rail by said retainer; and a connector for interconnecting a plurality of said retainer rails to each other, said connector being adapted to fit over said connector ribs.

2. The object retention system of claim 1, wherein said receivers extend across said vertical portion of said retainer rail.

3. The object retention system of claim 1, wherein said retainer includes a central portion between said first ribs and said second ribs.

4. The object retention system of claim 3, wherein said central portion is flexible.

5. The object retention system of claim 1, comprising a channel defined between said vertical portion, said horizontal portion, and said downward projection, said channel being adapted to fit over a structure.

6. The object retention system of claim 1, wherein a second end of said horizontal portion includes one or more barbs.

7. The object retention system of claim 1, wherein a lower end of said vertical portion includes a stiffener rib.

* * * * *